US005709716A

United States Patent [19]

Taylor

[11] Patent Number: 5,709,716

[45] Date of Patent: Jan. 20, 1998

[54] FIBRE TREATMENT

[75] Inventor: James Martin Taylor, Derby, United Kingdom

[73] Assignee: Courtaulds Fibres (Holdings) Limited, London, United Kingdom

[21] Appl. No.: 704,632

[22] PCT Filed: Mar. 6, 1995

[86] PCT No.: PCT/GB95/00484

§ 371 Date: Sep. 4, 1996

§ 102(e) Date: Sep. 4, 1996

[87] PCT Pub. No.: WO95/24524

PCT Pub. Date: Sep. 14, 1995

[30] Foreign Application Priority Data

Mar. 9, 1994 [GB] United Kingdom ..... 9404510

[51] Int. Cl.[6] ..... D06M 11/40; D06M 16/00; D06P 1/673; D06P 3/60

[52] U.S. Cl. ..... 8/401; 8/125

[58] Field of Search ..... 8/401, 125

[56] References Cited

U.S. PATENT DOCUMENTS

| | | | |
|---|---|---|---|
| 3,148,106 | 9/1964 | Mitchell | 162/18 |
| 4,246,221 | 1/1981 | McCorsley, III . | |
| 4,399,275 | 8/1983 | Sears | 536/70 |
| 5,580,354 | 12/1996 | Taylor | 8/538 |

FOREIGN PATENT DOCUMENTS

| | | |
|---|---|---|
| 1292813 | 9/1963 | France . |
| 303958 | 1/1929 | United Kingdom . |
| 936519 | 9/1963 | United Kingdom . |
| 8100120 | 1/1982 | WIPO . |

OTHER PUBLICATIONS

"Enzymatic and Acid Hydrolysis of Cotton Cellulose After Slack and Tension Mercerization", *Textile Chemist and Colorist*, vol. 26, No. 4, pp. 17–24, pbl 4–94 (Entire Article in the English language).

"Properties and Structure of Lyocell and Viscose–Type Fibres in the Swollen State", *Lenzinger Berichte*, pp. 19–25, publ. 9–94 (Entire article provided in the English language).

"Bio–Polishing—Ein Neuer Alternativer Veredelungsprozess Fur Cellulosefasern", *Lenzinger Berichte*, pp. 95–97, publ. Sep. 1994 (Article in the German Language, English language abstract provided on p. 95 of the article).

"Die Veredlung Von Lyocellfasern—Ein Erfahrungsbericht", *Lenzinger Berichte*, pp. 99–101, publ. Sep. 1994 (Article in the German language, English language abstract provided on p. 99 of the article).

*Primary Examiner*—Margaret Einsmann

*Attorney, Agent, or Firm*—Howson and Howson

[57] ABSTRACT

The color properties (i.e., the freedom from frosted ppearance, especially in dyed form) of lyocell fibre, in particular in fabric form, can be improved by mercerizing the fabric. The hand of the mercerized fabric can be softened to a marked degree by treatment with a cellulase enzyme.

8 Claims, No Drawings

FIBRE TREATMENT

FIELD OF THE INVENTION

This invention is concerned with methods of improving the visual appearance of lyocell fabrics.

It is known that man-made cellulose fibre can be made by extrusion of a solution of cellulose in a suitable solvent into a coagulating bath. One example of such a process is described in U.S. Pat. No. 4,246,221, the contents of which are incorporated herein by way of reference. Cellulose is dissolved in a solvent such as an aqueous tertiary amine N-oxide, for example N-methylmorpholine N-oxide. The resulting solution is then extruded through a suitable die into an aqueous bath to produce an assembly of filaments which is washed in water to remove the solvent and is subsequently dried. This process is referred to as "solvent-spinning", and the cellulose fibre produced thereby is referred to as "solvent-spun" cellulose fibre or as lyocell fibre. Lyocell fibre is to be distinguished from cellulose fibre made by other known processes, which rely on the formation of a soluble chemical derivative of cellulose and its subsequent decomposition to regenerate the cellulose, for example the viscose process.

As used herein, the term "lyocell fibre" means a cellulose fibre obtained by an organic solvent spinning process, wherein the organic solvent essentially comprises a mixture of organic chemicals and water, and wherein solvent spinning involves dissolving cellulose in the organic solvent to form a solution which is spun into fibre without formation of a derivative of the cellulose. As used herein, the terms "solvent-spun cellulose fibre" and "lyocell fibre" are synonymous. As used herein, the term "lyocell yarn" means a yarn which contains lyocell fibre, alone or in blend with other type(s) of fibre. As used herein, the term "lyocell fabric" means a fabric woven or knitted from yarns, at least some of which are lyocell yarns.

Fibres may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Dyed fabric containing fibrillated fibre tends to have a "frosted" visual appearance, which may be aesthetically undesirable. Such fibrillation is believed to be caused by mechanical abrasion of the fibres during treatment in a wet and swollen state. Wet treatment processes such as dyeing processes inevitably subject fibres to mechanical abrasion. Higher temperatures and longer times of treatment generally tend to produce greater degrees of fibrillation. Lyocell fibres appear to be particularly sensitive to such abrasion in comparison with other types of cellulose fibre, in particular cotton which has an inherently very low fibrillation tendency.

It is an object of the present invention to provide dyed lyocell fabric which does not exhibit a "frosted" appearance and which does not develop such a "frosted" appearance after repeated laundering. This improvement is referred to hereinafter as improving the colour properties of the lyocell fabric. This term "colour properties" is to be distinguished from the terms "uniform dyeability" and "level dyeing" commonly used in the art. In general, the levelness of dyeing of a fabric does not change on repeated laundering. Cotton is a natural fibre, and its dyeability varies from fibre to fibre. In contrast, lyocell fibres are made by a controlled manufacturing process and exhibit uniform dyeability. Cotton does not fibrillate, and so its colour properties do not change during processing or laundering. The colour properties of known lyocell fabric may change depending on the type of treatment to which it is subjected. For example, repeated laundering commonly induces fibrillation and worsens the colour properties of lyocell fabric, whereas enzyme (cellulase) treatment removes fibrils and generally improves the colour properties of the fabric.

BACKGROUND ART

It has been known for many years to subject cotton fibres, in particular in the form of yarn or fabric, to the process known as mercerisation. Mercerisation consists in treating the fibres with a strong alkali, usually aqueous sodium hydroxide, followed by washing with water and dilute acid to remove the alkali and drying. Cotton yarn and fabric may be held under tension during the treatment with alkali. The reasons for mercerising are to obtain (1) increased colour yield on dyeing or printing, (2) improved easy-care properties, (3) improved fibre lustre (when the cotton is held under tension during mercerising), and (4) more uniform dyeability. Cotton fibres are coated with mineral waxes and pectins which are removed by this treatment with aqueous alkali. Removal of these impurities increases the absorbency and dye receptiveness of the cotton fibres. If cotton contains a high proportion of thin-walled immature fibres, mercerising swells these fibres and makes them dye more like maturer fibres, thereby promoting uniform dyeing.

It is well known that man-made cellulose fibres such as viscose rayon and cuprammonium rayon fibres have naturally high dye receptiveness and lustre, generally higher than that of cotton. It is also well-known that such rayon fibres do not contain non-cellulosic waxy impurities. It is further well known that such rayon fibres are much less resistant than cotton to the action of sodium hydroxide. When rayon fibre is mercerised using 10 to 30 percent by weight aqueous sodium hydroxide, as might be used for cotton, the fibre becomes harsh and brittle, loses lustre and may partially dissolve in the mercerising liquor. When rayon fabric soaked with such strong solutions of sodium hydroxide is washed with water, it becomes very swollen and loses nearly all its strength, with the result that the fabric becomes very liable to mechanical damage.

DISCLOSURE OF THE INVENTION

According to the invention a method of improving the colour properties of lyocell fibre consists in mercerising the fibre.

The lyocell fibre may be subjected to mercerisation in the form of staple fibre, tow, continuous filaments, spun yarn or lyocell fabric. Mercerisation of lyocell fabric may be preferred.

A typical mercerisation process for cotton yarn or fabric includes the steps of:

(1) wetting the cotton with a solution of caustic soda (10 to 30, often 20 to 25, percent by weight sodium hydroxide in water) at ambient or slightly elevated temperature, for example at up to about 35° C.;

(1a) optionally washing with water;

(2) souring with dilute aqueous acid (for example up to 3, preferably 1 to 3, percent by weight of an inorganic acid such as sulphuric acid or hydrochloric acid or an organic acid such as acetic acid);

(3) washing one or more times with water to remove the acid; the final wash may optionally contain a slightly alkaline softener to neutralise the last traces of acid; and (4) drying the cotton, for example in an air dryer for 15 to 20 minutes at about 120° C. or other conventional manner.

Similar conditions and equipment are appropriate for lyocell fibre.

It is highly surprising that lyocell fibre, which is a man-made cellulose fibre, can satisfactorily be treated with strong alkali in a mercerisation process. Other man-made cellulose fibres, for example viscose rayon and cuprammonium rayon fibre, suffer severe damage under such conditions.

Lyocell fibre treated according to the method of the invention may subsequently be dyed using known dyestuffs for cellulose in known manner. Dyed lyocell fabric containing fibre treated by the method of the invention has good colour properties and retains good colour properties on repeated laundering. In particular, such fabric has a much less "frosted" appearance than fabric subjected to the same processing steps but with omission of the mercerising treatment of the invention.

Procedures are known in which lyocell fibre is treated with a variety of chemical reagents, for example crosslinking agents, thereby reducing the degree of fibrillation and/or the tendency to fibrillation of the fibre. Such procedures generally cause an improvement in the colour properties of the fibre. However, such known procedures may suffer from the disadvantage that the improvement thereby produced may not be permanent. The colour properties of the fibre may for example deteriorate during repeated laundering. Furthermore, such known procedures may impair the dyeability or physical properties of the fibre. The method of the invention has advantages-over such known procedures in that the improvement in colour properties thereby obtained remains through repeated laundering cycles; that the mercerised fibre has good dyeability; and that the mercerised fibre has good physical properties. In particular, lyocell fabric containing lyocell fibre treated by the method of the invention exhibits the characteristic attractive drape and soft hand associated with lyocell fabrics.

The reason for the improvement in the colour properties afforded by the invention is not fully understood. Unmercerised and mercerised samples of lyocell fabric appear very similar under the microscope, in particular in their degree of fibrillation, provided that they have otherwise been treated in the same way.

Lyocell fibre or fabric, particularly fabric, treated by the method of the invention may subsequently be treated with an aqueous solution of a cellulase enzyme to remove fibrils from the fabric in known manner. Many cellulase preparations suitable for the treatment of cellulosic fabrics are available commercially. Mercerisation generally hardens the handle of cellulosic fabrics. It has surprisingly been found that cellulase treatment softens the handle of mercerised lyocell fabric to an unexpectedly large extent.

The degree of fibrillation of lyocell fibres and fabrics may be assessed by the following test method:

Test Method (Assessment of Fibrillation)

There is no universally accepted standard for assessment of fibrillation, and the following method was used to assess Fibrillation Index (F.I.). Samples of fibre were arranged into a series showing increasing degrees of fibrillation. A standard length of fibre from each sample was then measured and the number of fibrils (fine hairy spurs extending from the main body of the fibre) along the standard length was counted. The length of each fibril was measured, and an arbitrary number, being the number of fibrils multiplied by the average length of each fibril, was determined for each fibre. The fibre exhibiting the highest value of this product was identified as being the most fibrillated fibre and was assigned an arbitrary Fibrillation Index of 10. A wholly unfibrillated fibre was assigned a Fibrillation Index of zero, and the remaining fibres were evenly ranged from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined numbers for each fibre were then averaged to give a Fibrillation Index for the sample under test. It will be appreciated that visual determination and averaging is many times quicker than measurement, and it has been found that skilled fibre technologists are consistent in their rating of fibres.

Fibrillation Index of fabrics can be assessed on fibres drawn from the surface of the fabric. Woven and knitted fabrics having F.I. of more than about 2.0 to 2.5 are normally found to exhibit an unsightly appearance.

The invention is illustrated by the following Examples, in which parts and proportions are by weight unless otherwise specified:

EXAMPLE 1

A piece of 2×1 twill fabric (190 g/m$^2$) woven from 100% Tencel 20 tex yarn (fibre 1.7 dtex) was prepared in open width by scouring with sodium carbonate and an anionic detergent at 90° C. and can-drying at 140° C. (Tencel is a Trade Mark of Courtaulds Fibres (Holdings) Limited for lyocell.) For mercerising, it was immersed in 14% aqueous sodium hydroxide at ambient temperature for 45 seconds, and mangled to give 70% add-on. The fabric was rinsed in water at 95° C., neutralised in water containing 1 ml/l acetic acid, rinsed again and dried.

This treated (mercerised) fabric was dyed together with an untreated piece in a rotary laboratory dyeing machine using a bath containing 4% Procion Blue HE-GN(Procion is a Trade Mark of Zeneca plc), 80 g/l Glaubers salt and 20 g/l soda ash at 80° C. The treated fabric dyed to a deeper shade than the untreated piece.

The two pieces of fabric were then washed at 60° C. and tumble-dried a total of five times. The appearance of the treated piece was considerably less frosty than that of the untreated control piece. Under the microscope, the fibrils in the treated sample appeared shorter than those in the control and appeared to be stuck to the main part of the fibre.

Samples of fibre were removed from the pieces of fabric and their F.I. assessed by the Test Method described above. The F.I. of fibres from the untreated control and the treated fabric were 5.2 and 3.1 respectively. The appearance of the mercerised fabric was satisfactory despite its relatively high F.I.

EXAMPLE 2

A piece of Tencel fabric as used in Example 1 was treated (mercerised) and dyed as in Example 1, except that a 25% solution of sodium hydroxide was used. The treated piece and an untreated control piece were washed a single time, after which fibrillation was observed to be more evident in the untreated piece. The two pieces of fabric were then immersed in an aqueous solution containing 3 ml/l Primafast 100 (a cellulase preparation available from Genencor) (Primafast is a Trade Mark) at pH 5.0 for 60 minutes at 55°

C. to remove fibrils, rinsed and dried. The two pieces were then laundered five tames in the manner described in Example 1. The F.I. of fibres removed from both pieces of fabric was 2.0. Nevertheless, the visual appearance of the treated piece was much cleaner and less frosted than that of the untreated control. The handle of both samples was very soft, with a "peach-skin" touch. The handle of the mercerised and cellulase-treated sample was markedly softer than that of a sample which had not been treated with cellulase.

I claim:

1. A method of improving the colour properties of lyocell fibre, comprising the step of mercerizing the fibre.

2. A method according to claim 1, wherein the lyocell fibre is present in a lyocell fabric.

3. A method according to claim 1, wherein the lyocell fibre is contacted with a solution of a cellulase enzyme after being mercerized.

4. A method according to claim 2, wherein the lyocell fibre is contacted with a solution of a cellulose enzyme after being mercerized.

5. A method according to claim 1, wherein the lyocell fibre is dyed after being mercerized.

6. A method according to claim 2, wherein the lyocell fibre is dyed after being mercerized.

7. A method according to claim 3 wherein the lyocell fibre is dyed after being mercerized.

8. A method according to claim 4, wherein the lyocell fibre is dyed after being mercerized.

* * * * *